US007222608B2

(12) United States Patent
Fujii

(10) Patent No.: US 7,222,608 B2
(45) Date of Patent: May 29, 2007

(54) INJECTOR FOR HIGH-PRESSURE INJECTION

(75) Inventor: Hiroto Fujii, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/216,183

(22) Filed: Sep. 1, 2005

(65) Prior Publication Data

US 2006/0060663 A1 Mar. 23, 2006

(30) Foreign Application Priority Data

Sep. 22, 2004 (JP) ..... 2004-275141

(51) Int. Cl.
*F02M 37/04* (2006.01)

(52) U.S. Cl. ..... 123/467; 123/501

(58) Field of Classification Search ..... 123/467, 123/500, 501, 446, 456; 239/86–95, 533.1–533.12
See application file for complete search history.

(56) References Cited

U.S. PATENT DOCUMENTS 5,711,279 A * 1/1998 Green et al. ..... 123/506
5,913,300 A * 6/1999 Drummond ..... 123/467
5,975,428 A 11/1999 Potschin et al.
6,145,492 A * 11/2000 Lixl ..... 123/467
6,684,855 B2 2/2004 Murakami et al.
6,698,666 B2 3/2004 Ohata et al.
6,718,946 B2 * 4/2004 Hokazono et al. ..... 123/445
6,915,785 B2 * 7/2005 Eisenmenger et al. ..... 123/446
2002/0088436 A1 * 7/2002 Kropp et al. ..... 123/447

* cited by examiner

*Primary Examiner*—Carl S. Miller
(74) *Attorney, Agent, or Firm*—Nixon & Vanderhye PC

(57) ABSTRACT

An injector has a housing, a command piston, a control chamber, a needle, a nozzle chamber, a fuel inflow passage, a fuel discharge passage and an electric valve. The housing slidably supports the command piston and the needle. The housing and one end face of the command piston enclose the control chamber. The needle is disposed at the other end face side of the command piston. The housing and a leading end portion of the needle enclose the nozzle chamber to accumulate the high-pressure fuel therein. The housing is provided with an injection hole, which is opened and blocked by the needle. The fuel discharge passage opens at a fuel discharge port to the control chamber to discharge the high-pressure fuel out of the control chamber. The fuel discharge port is close to an uppermost position of the command piston.

13 Claims, 5 Drawing Sheets

INJECTOR FOR HIGH-PRESSURE INJECTION

CROSS REFERENCE TO RELATED APPLICATION

This application is based upon and claims the benefit of priority of Japanese Patent Application No. 2004-275141 filed on Sep. 22, 2004, the content of which is incorporated herein by reference.

FIELD OF THE INVENTION

The present invention relates to an injector for injecting high-pressure fuel.

BACKGROUND OF THE INVENTION

Current strict low emission vehicle regulations in each country request pretty high injection accuracy in each fuel injection. Specifically, recent diesel engines are requested to perform pilot-injections or multi-injections in accordance with the strict low emission vehicle regulations, so that it is required to increase an injection accuracy of each fuel injection. However, manufacturing tolerances and/or secular changes occurring in the injector may change injection amount and/or injection timing. Thus, it is requested to develop an injector maintaining high injection accuracy over a long period of usage.

In the following is described an example in which the manufacturing tolerances and/or secular changes spoil a fuel injection accuracy of the injector.

FIG. 5 schematically depicts a structure of a conventional injector 3 (refer to U.S. Pat. No. 6,698,666-B and its counterpart JP2003-97378-A, for example). The injector 3 has a fuel inflow passage 31, a fuel discharge passage 32, a control chamber 33, a control valve 34, a command piston 35, a needle 36, a housing 38 and a nozzle chamber 44. The housing 38 supports the command piston 35 and the needle 36 to allow a reciprocating motion therein. The housing 38 and the command piston 35 enclose the control chamber 35 therebetween to define an outline thereof. High-pressure fuel is introduced through the fuel inflow passage 31 into the control chamber 33. The high-pressure fuel accumulated in the control chamber 33 is discharged through the fuel discharge passage 32. The fuel discharge passage 32 is blocked and opened by the control valve 34, which is actuated by an electric valve such as an electromagnetic valve. The nozzle chamber 44 is disposed around the needle 36, and a high-pressure fuel is supplied thereinto to push the needle 36 in a valve-opening direction.

As shown in FIG. 2A, when the injector 3 opens, the electromagnetic valve is turned on to draw up the control valve 34 to open the fuel discharge passage 32. Then, a piston control pressure $P_{cc}$, which is a pressure exerted by the high-pressure fuel in the control chamber 33 on the command piston 35 in an axial direction of the injector 3, decreases from a common rail pressure $P_c$ to a valve-opening pressure $P_{opn}$; thereby a conically-shaped needle head 36*a* lifts off the needle seat 45, which is formed in the housing, to start injecting the high-pressure fuel through the injection holes 46. It takes a time (hereinafter referred to as an injection start delay) $T_{ds}$ from turning on the electromagnetic valve to the fuel injection start by a decrease of the piston control pressure $P_{cc}$ below the valve-opening pressure $P_{opn}$.

That is, the command piston 35 receives the piston control pressure $P_{cc}$ in a valve-closing direction (downward in FIG. 1). The needle 36 receives a counter-pressure $P_c$ in a valve-opening direction (upward in FIG. 1). The counter-pressure $P_c$ is approximately equal to the common rail pressure $P_c$. Thus, in order to start fuel injection by the injector 3, a pressure difference ($P_c$–$P_{cc}$) must be over a valve-opening pressure difference $dP_0$. Thus, in order to start fuel injection by the injector 3, it is necessary to decrease the piston control pressure $P_{cc}$ below the valve-opening pressure $P_{opn}$ so that the pressure difference $dP_0$ ($P_c$–$P_{cc}$) becomes over the valve-opening pressure difference $dP_0$.

In simple explanation to disregard a valve return force exerted by a valve return spring on the command piston 35 in the valve-closing direction, the piston control pressure $P_{cc}$ exerts a valve-closing force on the command piston 35 as much as a product ($P_{cc}$×$S_{cc}$) of the piston control pressure $P_{cc}$ and a pressure-receiving area $S_{cc}$ on an upstream end face of the command piston 35. The counter-pressure $P_{cc}$ exerts a valve-opening force on the command piston 35 as much as a product ($P_c$×$S_{nc}$) of the counter-pressure $P_c$ and a pressure-receiving area $S_{nc}$ on a downstream end face of the command piston 35. Thus, if manufacturing tolerances and/or secular changes occur in a diameter $D_{ns}$ of a needle seat portion 47, the pressure-receiving area $S_{cc}$ changes, thereby the above-described valve-opening force also changes. Specifically, the valve-opening pressure $P_{opn}$ decreases to $P_{opn}'$ as shown in FIG. 2A. Accordingly, in order to start fuel injection by the injector 3, it is necessary to adjust the piston control pressure $P_{cc}$.

A change of the valve-opening pressure from $P_{opn}$ to $P_{opn}'$ further changes the injection start delay from $T_{ds}$ to $T_{ds}'$. That is, if the diameter $D_{ns}$ of the needle seat portion 47 includes a relatively large tolerance or error, the injection start delay changes from $T_{ds}$ to $T_{ds}'$, so that a target injection amount $Q_0$ and a target injection timing $T_0$, which are calculated in accordance with a current driving condition, include errors to spoil a high accuracy in fuel injection deviated from ideal values thereof.

When the injector 3 is closed to stop fuel injection, as shown in FIGS. 6A and 6B, the needle head 36*a* is apart from the needle seat 45, so that the valve-closing timing is not deviated by a change of the diameter $D_{ns}$ of the needle seat portion 47. That is, the valve-closing timing is not affected by the manufacturing tolerances and/or secular changes occurring, which may occur in the diameter $D_{ns}$ of a needle seat portion 47.

SUMMARY OF THE INVENTION

The object of the present invention, in view of the above-described issues, is to provide an injector having a relatively rapid injection response and high accuracy regardless of manufacturing tolerances and secular changes.

The injector has a housing, a command piston, a control chamber, a needle, a nozzle chamber, a fuel inflow passage, a fuel discharge passage and an electric valve. The housing slidably supports the command piston. The housing and one end face of the command piston enclose the control chamber. The needle is disposed at the other end face side of the command piston and slidably supported by the housing. The housing and a leading end portion of the needle encloses the nozzle chamber to accumulate the high-pressure fuel therein. The housing is provided with an injection hole, which is opened and blocked by the needle. The fuel discharge passage opens at a fuel discharge port to the control chamber to discharge the high-pressure fuel out of the control chamber. The fuel discharge port is close to an uppermost position of the command piston. The electric valve is for opening and blocking the fuel discharge passage.

BRIEF DESCRIPTION OF THE DRAWINGS

Other objects, features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS

Figure 2A:
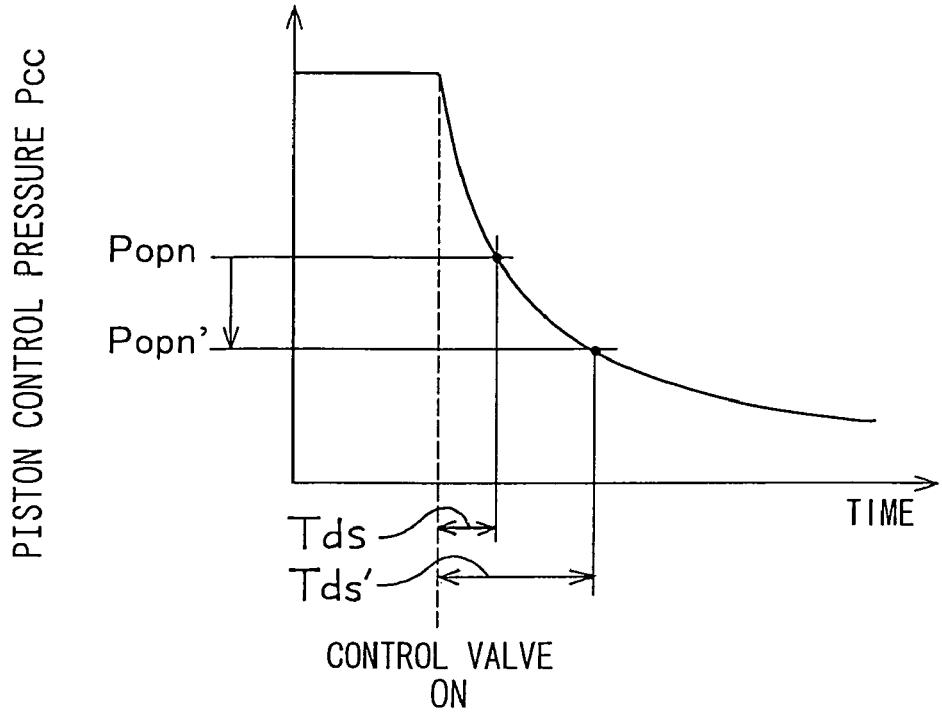
FIG. 2A PRIOR ART
FIG. 2A is a graph showing a piston control pressure characteristic after opening a control valve according to a conventional injector.
Figure 2B:
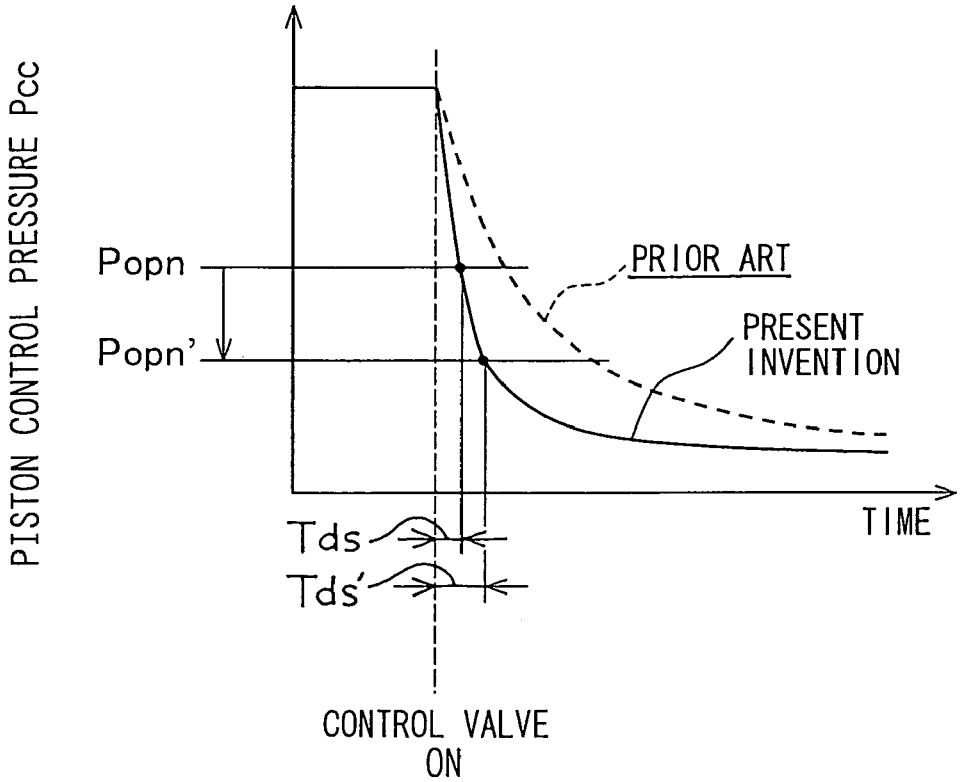
FIG. 2B is a graph showing a piston control pressure characteristic of the injector according to the embodiment after opening a control valve.
Figure 3A:
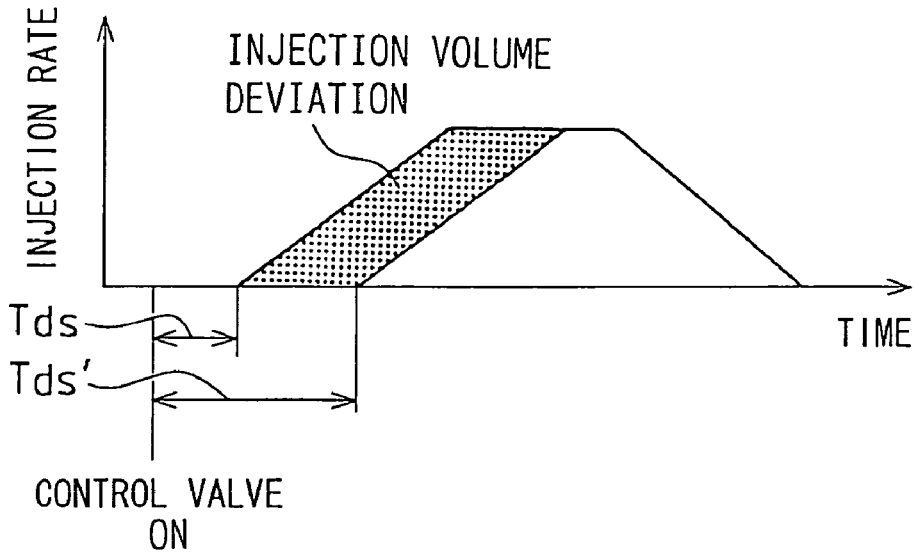
FIG. 3A PRIOR ART
FIG. 3A is a graph showing an injection rate transition of a conventional injector.
Figure 3B:
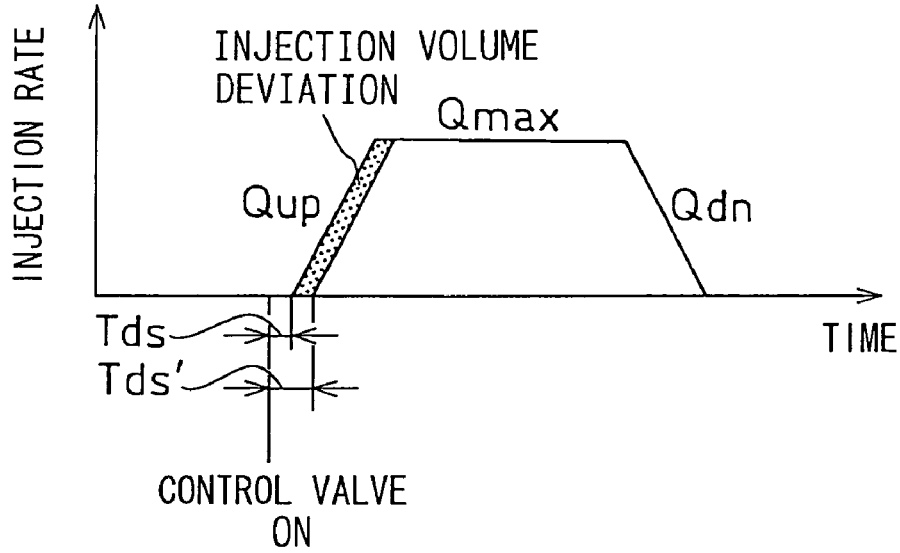
FIG. 3B is a graph showing an injection rate transition of the injector according to the embodiment.
Figure 4:
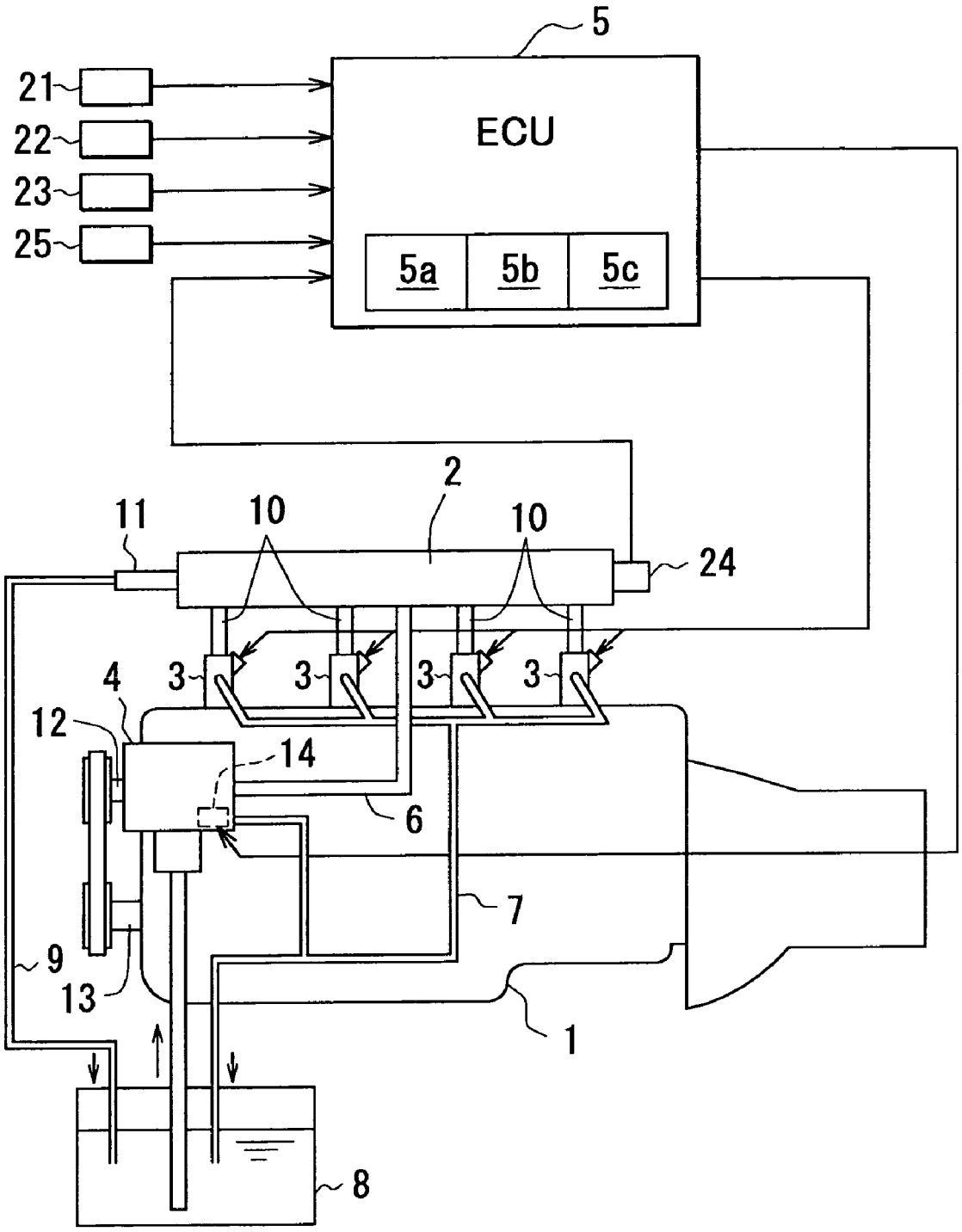
FIG. 4 is a schematic diagram showing a common rail fuel injection system having the injector according to the present embodiment.
Figure 5:
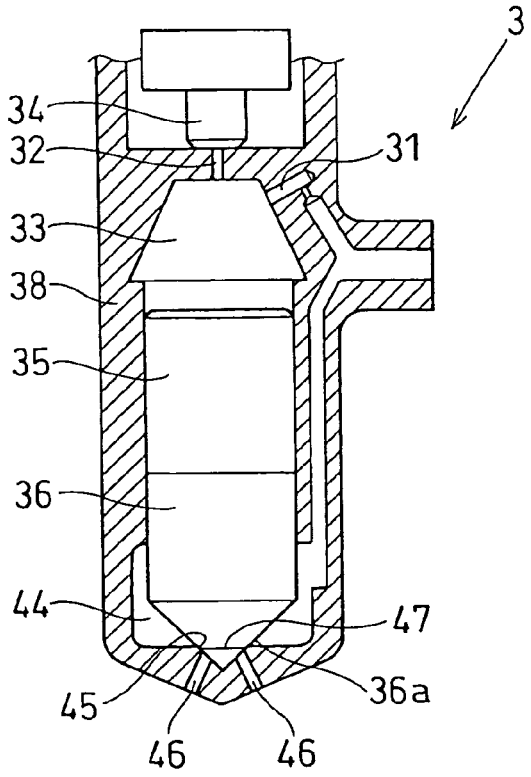
FIG. 5 PRIOR ART
FIG. 5 is a schematic cross-sectional view of the conventional injector.
Figure 6A:
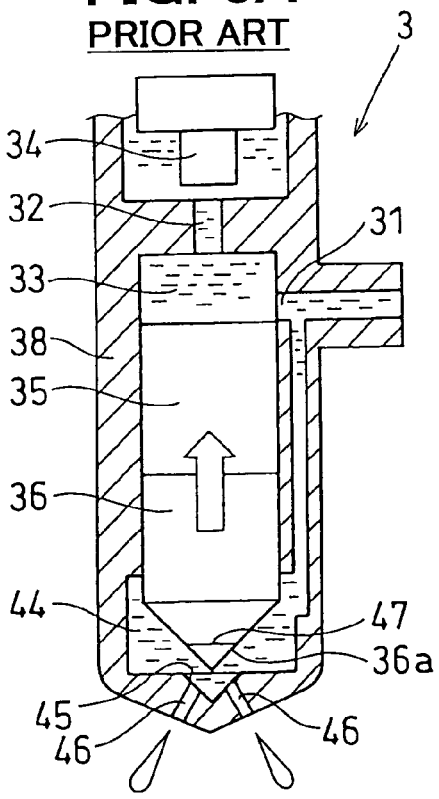
FIG. 6A PRIOR ART
FIG. 6A is an illustration of an action of the conventional injector.
Figure 6B:
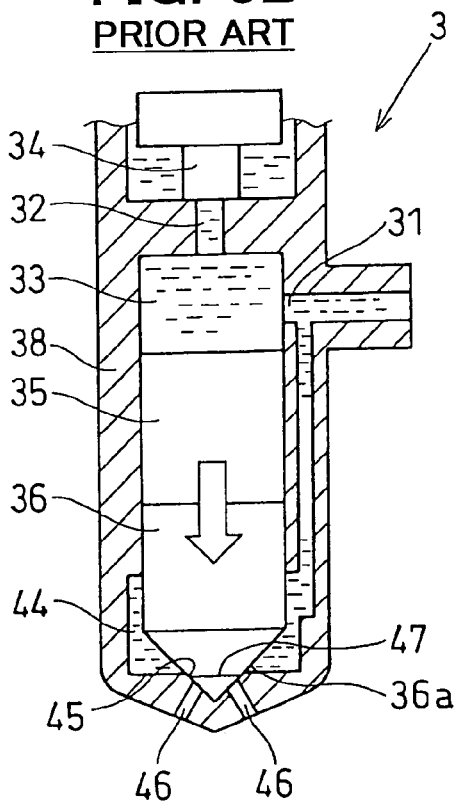
FIG. 6B PRIOR ART
FIG. 6B is an illustration of an action of the conventional injector.

An injector 3 according to a first embodiment of the present invention is described in the following with reference to FIGS. 1, 2A, 2B, 3A, 3B and 4. The injector 3 forms a common rail fuel injection system for a diesel engine 1 together with a common rail 2, a fuel pump 4, an engine control unit (ECU) 5 and so on. The ECU 5 is for controlling operations of the injector 3 and other components of the common rail fuel injection system. The diesel engine 1 has a plurality of cylinders to perform an intake stroke, a compression stroke, a power stroke and an exhaust stroke in turn repeatedly. FIG. 4 depicts the common rail fuel injection system having four cylinders, just for instance, and the number of the cylinders can be changed accordingly.

The common rail 2 is an accumulation chamber to accumulate high-pressure fuel, which is to be supplied to the injectors 3. A fuel line (high-pressure fuel passage) 6 connects an outlet port of the fuel pump 4 to the common rail 2 to maintain a predetermined common rail pressure $P_c$, which is a pressure of the high-pressure fuel accumulated in the common rail 2 and corresponds to a fuel supply pressure to the injectors 3. A leakage fuel line (fuel recycle passage) 7 sends leakage fuel of the injectors 3 back to a fuel tank 8. A relief line, which connects the common rail 2 to the fuel tank 8, is provided with a pressure limiter 11. Specifically, the pressure limiter 11 is a pressure safety valve, which opens when a fuel pressure in the common rail 2 reaches a specific critical pressure to limit the fuel pressure within the predetermined critical pressure.

The injector 3 is inserted in and mounted on an engine head of every cylinder of the diesel engine 1. The injectors 3 are connected to downstream ends of high-pressure fuel lines 10, which are branched off the common rail 2, and inject high-pressure fuel supplied from a common rail 2 into the cylinders of the diesel engine 1. Detailed structure of the injector 3 will be described later.

The fuel pump 4 supplies fuel to the common rail 2 at high pressure. Specifically, the fuel pump 4 includes a feed pump and a high-pressure pump. The feed pump sucks fuel from the fuel tank 8, and the high-pressure pump pressurizes the fuel sucked by the feed pump then supplies the fuel to the common rail 2. A single cam shaft 12 drives the feed pump and the high pressure pump. The cam shaft 12 is rotated by a crank shaft 13 of the diesel engine 1 and the like. The fuel pump 4 is provided with a suction control valve (SUV) 14, and the ECU 5 controls the SCV 14 to adjust the common rail pressure $P_c$.

The ECU 5 includes a microcomputer having a conventional structure provided with a CPU, a memory device, an input circuit, an output circuit, a power source circuit, a injector driving circuit, a pump driving circuit. The memory device is formed by a ROM, a read-write memory (EEPROM, etc.), RAM and the like and stores programs and data therein. The CPU receives electrical signals, which are sent out of sensors in accordance with driving conditions of the diesel engine 1 and/or operational conditions by a driver sent from sensors, and performs control processes and numerical computations based on the electric signals. The sensors include, for instance, a throttle sensor 21 for detecting an opening degree of a throttle, a rotational frequency sensor 22 for detecting a rotational frequency of the diesel engine 1, a coolant temperature sensor 23 for detecting a coolant temperature of the diesel engine 1, a common rail pressure sensor 24 for detecting the common rail pressure $P_c$ and other sensors 25.

The ECU 5 includes a target injection amount calculator 5*a* and a target injection timing calculator 5*b* as a program for a drive control of the injector 3. The ECU 5 further includes a target pressure calculator 5*c* as a program for a drive control of the SCV 14, that is, as a program for an outlet pressure control of the duel pump 4.

The target injection amount calculator 5*a* is a control program that determines a target injection amount $Q_0$ in accordance with a current driving condition, then determines an injector driving time to inject fuel as much as the target injection amount $Q_0$, and generates an injection duration signal, specifically a duration time of an on signal of an injection signal or a driving time of the injector 3, to perform fuel injection for the injector driving time.

The target injection timing calculator 5*b* is a control program that determines a target injection timing $T_0$ to start an ignition at an ideal ignition timing in accordance with the current driving condition, then determines an injection command timing to start fuel injection at the target injection timing $T_0$, and generates an injection start signal, specifically turning on the injection signal, in the injector driving circuit at the injection command timing.

The target pressure calculator 5*c* is a control program that determines a target common rail pressure $P_{c0}$ (the fuel supply pressure), then determines an opening decree of the SCV 14 to adjust the detected common rail pressure $P_{ci}$, which is detected by a common rail pressure sensor 24, to the target common rail pressure $P_{c0}$, and generates a valve opening signal such as a PWM signal in a SCV driving circuit to set the SCV 14 to the SCV opening degree.

Figure 1:
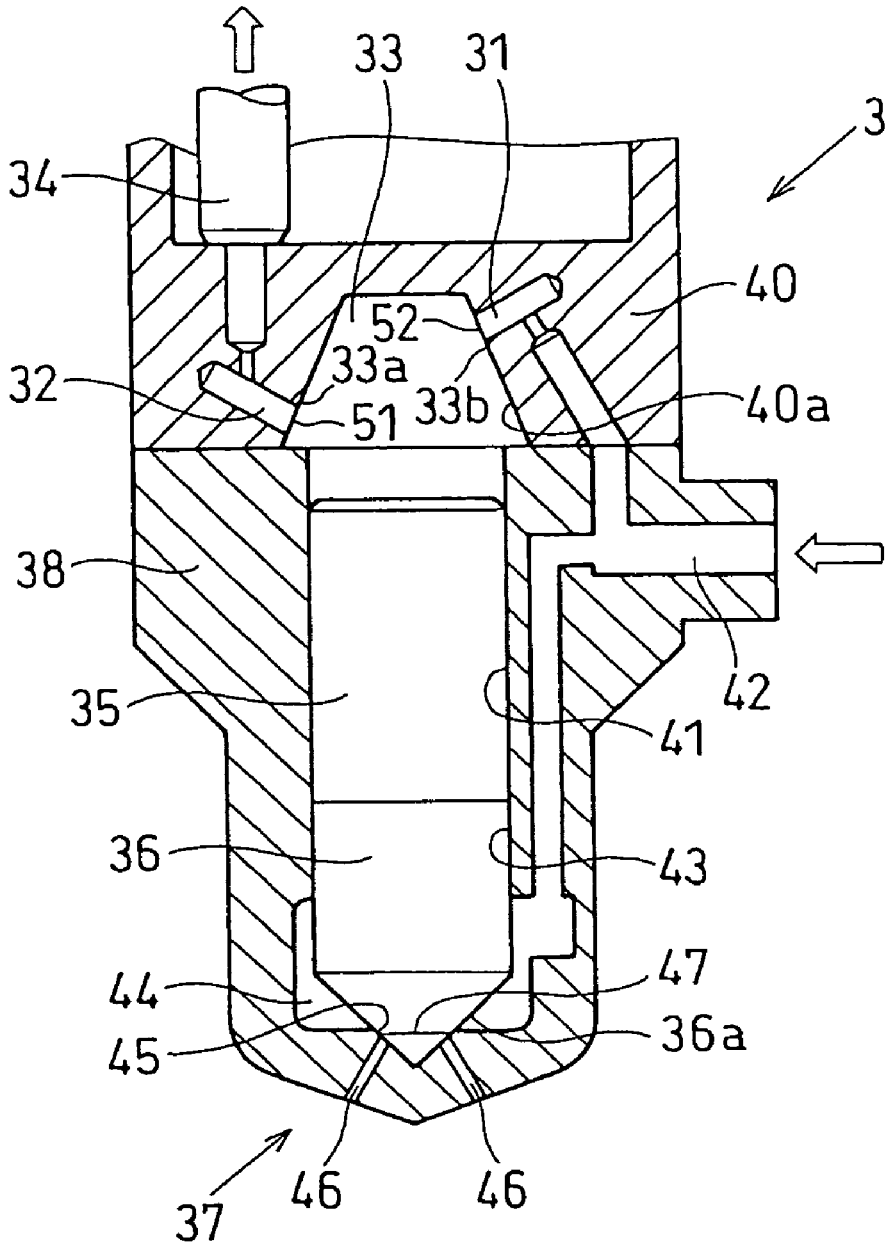
FIG. 1 is a schematic cross-sectional view of the injector according to an embodiment of the present invention.

The detailed structure of the injector 3 is described with reference to FIG. 1. The injector 3 is for injecting high-pressure fuel supplied from the common rail 2 into the cylinder of the diesel engine 1. Specifically, the injector 1 has a fuel inflow passage 31, a fuel discharge passage 32, a control chamber 33, a control valve 34, a command piston 35, a needle 36 and a nozzle 37. A fuel pressure in the control chamber 33 serves as a piston control pressure $P_{cc}$ to exert a valve-closing force on an upstream end face of the command piston 35. The fuel inflow passage 31 introduces the high-pressure fuel into to the control chamber 33 to increase the piston control pressure $P_{cc}$ up to the common rail pressure $P_{cc}$. An electromagnetic valve serves as the control valve 34 opens and blocks the fuel discharge passage 32 to adjust the piston control pressure $P_{cc}$ by fuel leakage out of the control chamber 33. When the piston control pressure $P_{cc}$ decreases below a valve-opening pressure $P_{opn}$, the needle 36 lifts up to inject fuel through the nozzle 37.

A housing 38, such as a nozzle holder, of the injector 3 is provided with a cylinder 41, a high-pressure fuel passage 42, a low-pressure fuel passage (not shown) and so on. The cylinder 41 is formed in the housing 38 and reciprocatably installs the command piston 35 therein. The high-pressure fuel passage 42 introduces high-pressure fuel, which is supplied via the high-pressure fuel line 10 from the common rail 2, to the nozzle 37 and to the fuel inflow passage 31. The low-pressure fuel passage introduces leakage fuel of the injector 3 to a leakage fuel line 7, which is at a low-pressure side. A pressure pin (not shown) is interposed between the command piston 35 and a needle 36 to connect them to each other. A spring (not shown) is disposed around the pressure pin to exert a restitutive force to seat the needle 36 on a valve seat 45. The housing and the command piston 35 enclose the control chamber 33 therebetween at a downstream side space in the cylinder 41 to define an outline thereof. The control chamber 33 changes its volume in accordance with a reciprocating motion of the command piston 35. An upstream end face of the command piston 35, which corresponds to a pressure-receiving area Scc, receives the fuel pressure in the control chamber to seat itself on the valve seat 45. Specifically, a downstream side surface of a plate 40, which is disposed at an upstream side of the housing 38, is provided with a depression 40*a* to be communicated with the cylinder 41, and an interior of the depression 40*a* serves as the control chamber 33. The fuel inflow passage 31 introduces fuel supplied from the high-pressure fuel passage 42 into the control chamber 33. An inflow orifice is installed in the fuel inflow passage 31 to restrict a flow rate of the high-pressure fuel flowing from the high-pressure fuel passage 42 into the control chamber 33. A discharge orifice is installed in the fuel discharge passage 32 to restrict a flow rate of the fuel flowing from the control chamber 33 to the leakage fuel line 7.

The electromagnetic valve is provided with a solenoid (not shown), the valve 34 and a valve return spring (not shown). The valve return spring pushes the valve 34 to block the fuel discharge passage 32. The solenoid generates an electromagnetic force by being activated to move the valve 34 to open the fuel discharge passage 32 against a restitutive force of the valve return spring. A leading end face of the valve 34 is provided with a ball valve (not shown) to open and close a downstream end opening of the fuel discharge passage 32. When the solenoid is not energized, the restitutive force of the valve return spring pushes the ball valve to block the fuel discharge passage 32. When the solenoid is energized, the valve 34 moves against the restitutive force of the valve return spring 34 to lift the ball valve off a valve seat to open the fuel discharge passage 32.

The housing 38 is further provided with a cylindrical hole 43, a nozzle chamber 44, a needle seat 45 and a plurality of injection holes 46. The cylindrical hole 43 supports the needle 36 to reciprocate therein to open and close the nozzle 37. The nozzle chamber 44 is an annular space surrounding the cylindrical hole 43. The nozzle chamber 44 is communicated with the high-pressure fuel passage 42. The needle seat 45 has a conical shape to seat a conically-shaped needle head 36*a* of the needle 36 thereon. The injection holes 46 are disposed inside a diameter $D_{ns}$ of a nozzle seat portion 47, in which the needle 36 seats on the needle seat 45 for injecting high-pressure fuel therethrough.

A downstream side face of the needle 36, which is exposed in the nozzle chamber 44, receives the common rail pressure $P_c$ from the high-pressure fuel therein in an axial direction of the injector 3. A projected area of the downstream side face in the axial direction corresponds to a pressure-receiving area $P_n$, in which the needle 36 receives the common rail pressure $P_c$. The needle 36 has the needle head 36*a* on the downstream side face to be seated on and lifted off the needle seat 45 to open and close the injection holes 46. The nozzle head 36*a* has a conical base portion at an upstream side thereof and a conical tip portion at a downstream side thereof. A boundary between the conical base portion and the conical tip portion seats on the nozzle seat portion 47. The conical tip portion is shaped obtuse with respect to the conical base portion, so that the boundary between the conical base portion and the conical tip portion comes in contact with the nozzle seat portion 47 to interrupt a communication between the nozzle chamber 44 and the injection holes 46.

Next, a fuel injection operation of the injector 1 is described. When the ECU 5 starts generating an electric pulse as the fuel duration signal to activate (turn on) the electromagnetic valve, the solenoid draws up the control valve 34 to open the fuel discharge passage 32, then the piston control pressure $P_{cc}$ in the control chamber 33 starts decreasing by the fuel discharge through the fuel discharge passage 32 and the fuel inflow restriction through the inflow orifice installed in the fuel inflow passage 31. When the piston control pressure $P_{cc}$ decreases below the valve-opening pressure $P_{opn}$, the needle 36 starts lifting off the needle seat 45 to communicate the nozzle chamber 44 with the injection holes 46 to inject the high-pressure fuel supplied in the nozzle chamber 44 through the injection holes 46. The time from turning on the electromagnetic valve to the fuel injection start is referred to as an injection start delay $T_{ds}$. As shown in FIG. 3B, a starting injection rate $Q_{up}$, which is a fuel injection rate at a start of the fuel injection, gradually increases in accordance with the lift of the needle 36. The starting injection rate $Q_{up}$ increases up to a maximum injection rate $Q_{max}$, then the maximum injection rate $Q_{max}$ is maintained while the fuel discharge passage 32 is open.

When the ECU 5 stops generating the electric pulse to deactivate (turn off) the electromagnetic valve, the solenoid stops drawing the control valve 34 to block the fuel discharge passage 32 again, then the piston control pressure $P_{cc}$ in the control chamber 33 starts increasing by the fuel inflow through the fuel inflow passage 31. When the piston control pressure $P_{cc}$ increases over a valve-closing pressure, the needle 36 starts lifting down on the needle seat 45 to interrupt the communication between the nozzle chamber 44 and the injection holes 46 to stop fuel injection through the injection holes 46.

If the electromagnetic valve is turned off before the starting injection rate $Q_{up}$ reaches the maximum injection rate $Q_{max}$ in a small injection such as a pilot injection in a multi injection, the injection rate plots an approximately triangular variation. If the electromagnetic valve is turned off after the starting injection rate $Q_{up}$ reaches the maximum injection rate $Q_{max}$ in a large injection such as a normal injection or a main injection in a multi injection, the injection rate plots an approximately trapeziform variation as shown in FIG. 3B.

First Distinctive Feature

A first distinctive structure of the injector 3 according to the embodiment is described in the following with reference to FIG. 1.

A fuel discharge port 51, which is an opening of the fuel discharge passage 32 in the control chamber 33, is disposed as close as possible to the command piston 35 so as not to be blocked by the command piston 35. That is, the fuel discharge port 51 is closer to the command piston 35 than the fuel discharge port 51 is. Specifically, the fuel discharge port 51 is disposed on a circumferential face of the depression 40*a*, which is formed in the plate 40. The fuel discharge port 51 is closer to a downstream end (command piston 35 side end) of the depression 40*a* than to a bottom of the depression 40*a* in the axial direction of the injector 3 (in a reciprocation direction of the command piston 35). It is desirable that the fuel discharge port 51 is disposed as close as possible to the upstream end face (pressure-receiving face) of the command piston 35.

Further, at a proximity of the fuel discharge port 51, a radial center axis of the fuel discharge passage 32 is disposed orthogonal to a portion 33*a* of the circumferential face of the depression 40*a*, on which the fuel discharge port 51 is disposed. Alternatively, the fuel discharge passage 32 may be disposed not to be orthogonal to the portion 30*a* of the circumferential face of the depression 40*a*.

The fuel discharge port 51 disposed at a proximity to the command piston 35 generates an advantage as in the following. When the electromagnetic valve is turned on to open the fuel discharge passage 32, the fuel pressure at a proximity to the command piston 35 in the control chamber 33 starts decreasing faster than the fuel pressure at a proximity to the bottom of the depression 40*a*; thereby the fuel pressure applying a valve-closing force on the upstream end face of the command piston 35, namely the piston control pressure $P_{cc}$, decreases fast. Thus, as shown in FIG. 2B, the piston control pressure $P_{cc}$ decreases below the valve-opening pressure $P_{opn}$ in a relatively short time, so as to decrease the fuel injection delay $T_{ds}$ with respect to conventional arts; thereby the injector 3 is provided with a fine response in starting fuel injection. A fast decrease of the piston control pressure $P_{cc}$ lifts the needle more rapidly than conventional arts. Thus, as shown in FIG. 3B, the starting injection rate $Q_{up}$ increases more rapidly with respect to conventional arts; thereby the injector 3 is provided with a fine response in starting fuel injection.

Further, when the electromagnetic valve is turned on to open the fuel discharge passage 32, the piston control pressure $P_{cc}$ decreases fast. Thus, even when manufacturing tolerances and/or secular changes may occur in the diameter $D_{ns}$ of the needle seat portion 47 to bring a large change in the valve-opening pressure ($P_{opn}-P_{opn}'$), the deviation of the injection start delay ($T_{ds}'-T_{ds}$) is limited within a short time. That is, even when manufacturing tolerances and/or secular changes may occur in the diameter $D_{ns}$ of the needle seat portion 47, the deviation of the injection start delay ($T_{ds}'-T_{ds}$) is limited within a short time. Accordingly, it is possible to restrict errors of injection timing, namely a difference between the target injection timing $T_0$ and the actual injection timing $T_i$, so as to secure relatively high injection accuracy.

Second Distinctive Feature

A second distinctive structure of the injector 3 according to the embodiment is described in the following.

A fuel discharge port 51, is disposed as close as possible to the command piston 35 in its uppermost position so as not to be blocked by the command piston 35. The fuel inflow port 52 is further from the command piston 35 than the fuel discharge port 51 is. Specifically, the fuel inflow port 52 is disposed together with the fuel discharge port 51 on a circumferential face of the depression 40*a*. The fuel inflow port 52 is further to the downstream end of the depression 40*a* than to a bottom of the depression 40*a* in the axial direction of the injector 3. It is desirable that the fuel inflow port 52 is disposed as far as possible to the upstream end face (pressure-receiving face) of the command piston 35.

Further, at a proximity of the fuel inflow port 52, a radial center axis of the fuel inflow passage 31 is disposed orthogonal to a portion 33*b* of the circumferential face of the depression 40*a*, on which the fuel inflow port 52 is disposed. Alternatively, the fuel inflow passage 31 may be disposed not to be orthogonal to the portion 30*a* of the circumferential face of the depression 40*a*.

As described above, the fuel discharge port 51 is disposed close to the command piston 35. In addition to this structure, the fuel inflow port 52 is disposed further from the command piston 35 than the fuel discharge port 51. The fuel inflow port 52 and the fuel discharge port 51 disposed as described above generate an advantage as in the following. When the electromagnetic valve is turned off to block the fuel discharge passage 32, a fuel flow is ceased at a proximity to the control valve 34 of the electromagnetic valve. It takes some time for the fuel flow is ceased at an upstream side in the control chamber 33 due to viscoelasticity of the fuel. Thus, the fuel flow at the fuel discharge port 51, which is close to the control valve 34 of the electromagnetic valve, stops earlier than the fuel flow at the fuel inflow port 51 does due to viscoelasticity of the fuel.

A fast stop of the fuel flow is equivalent to a fast increase of the fuel pressure, and a slow stop of the fuel flow is equivalent to a slow increase of the fuel pressure. As described above, the fuel discharge port 51 is disposed close to the command piston 35 side end of the depression 40*a*, and the fuel inflow port 52 is disposed close to the bottom of the depression 40*a*, which is opposite from the command piston 35 side end; thereby the fuel pressure at a proximity to the command piston 35 increase earlier than the fuel pressure at other positions in the control chamber 33. Thus, in stopping the fuel injection from the injector 3, the piston control pressure $P_{cc}$ increases rapidly. Accordingly, the needle 36 seats on the needle seat 45 fast, as shown by a steep decline of a stopping injection rate $Q_{dn}$ in FIG. 3B. That is, the injector 3 stops fuel injection sharp by stopping the fuel injection rapidly. By stopping the fuel injection sharp, the injector 3 serves for decreasing a production of hazardous substances such as hydrocarbon (HC), particulate matters (PM), which are generated by dispersed fuel at a final stage in each fuel injection.

Modified Embodiment

The injector 3 according to the above-described embodiment is provided with the electromagnetic valve that actuates the valve 34 by a drawing force of the solenoid. Alternatively, the present invention can be naturally applied to an injector provided with other kinds of electric actuators such as piezoelectric actuator for actuating the valve 34.

The injector 3 according to the above-described embodiment is incorporated in a common rail fuel injection system for the diesel engine 1. Alternatively, the present invention is used in other kinds of fuel injection system such for a gasoline engine that has no common rail therein.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. An injector for injecting high-pressure fuel comprising:

a housing;

a command piston supported by the housing to reciprocate therein;

a control chamber enclosed by the housing and one end face of the command piston;

a needle disposed at the other end face side of the command piston and slidably supported by the housing;

a nozzle chamber enclosed by the housing and a leading end portion of the needle to accumulate the high-pressure fuel therein and provided with an injection hole for injecting the high-pressure fuel therethrough, the injection hole being opened and blocked by the leading end portion of the needle;

a fuel inflow passage opening to the control chamber to supply the high-pressure fuel into the control chamber;

a fuel discharge passage opening at a fuel discharge port to the control chamber to discharge the high-pressure fuel out of the control chamber, the fuel discharge port being as close to an uppermost position of the command piston, at which the command piston minimizes a volume of the control chamber, as possible without the fuel discharge port being blocked by the command piston in said uppermost position; and an electric valve for opening and blocking the fuel discharge passage.

2. The injector according to claim 1, wherein the fuel discharge port is disposed closer to the uppermost position than to a bottom of the control chamber which is opposite from the uppermost position in an axial direction of the command piston.

3. The injector according to claim 1, wherein:

the housing includes a housing body and a plate fixed to the housing body, the plate having a depression to serve as the control chamber; and the fuel discharge port is disposed on a circumferential face of the depression.

4. The injector according to claim 1, wherein the fuel inflow passage opens at a fuel inflow port to the control chamber, the fuel inflow port being further from the uppermost position than the fuel discharge port.

5. The injector according to claim 4, wherein the fuel inflow port is disposed closer to a bottom of the control chamber which is opposite from the uppermost position in an axial direction of the command piston than to the uppermost position.

6. The injector according to claim 4, wherein:

the housing includes a housing body and a plate fixed to the housing body, the plate having a depression to serve as the control chamber; and the fuel inflow port is disposed on a circumferential face of the depression.

7. An injector for injection high-pressure fuel, comprising:

a housing;

a piston assembly supported by the housing to reciprocate therein;

a control chamber defined by the housing and one longitudinal end face of the piston assembly;

a needle operatively coupled to the other longitudinal end of the piston assembly and slidably supported by the housing;

a nozzle chamber defined by the housing and a leading end portion of the needle to accumulate the high-pressure fuel therein and provided with an injection hole for injecting the high-pressure fuel therethrough, the injection hole being opened and blocked by the leading end portion of the needle;

a fuel inflow passage opening to the control chamber to supply the high-pressure fuel into the control chamber;

a fuel discharge passage opening at a fuel discharge port to the control chamber to discharge the high-pressure fuel out of the control chamber, the fuel discharge port being as close to an uppermost position of the piston assembly, at which the piston assembly minimizes a volume of the control chamber, as possible without the fuel discharge port being blocked by the command piston in said uppermost position; and a valve for opening and blocking the fuel discharge passage to discharge the high-pressure fuel out of the control chamber.

8. The injector according to claim 7, wherein:

the housing includes a housing body and a plate fixed to the housing body, the plate having a depression to serve as the control chamber; and the fuel discharge port is disposed on a circumferential face of the depression.

9. The injector according to claim 7, wherein the fuel inflow passage opens at a fuel inflow port to the control chamber, the fuel inflow port being further from the uppermost position than the fuel discharge port.

10. The injector according to claim 9, wherein:

the housing includes a housing body and a plate fixed to the housing body, the plate having a depression to serve as the control chamber; and the fuel inflow port is disposed on a circumferential face of the depression.

11. The injector according to claim 1, wherein:

said valve for opening and blocking the fuel discharge passage is disposed downstream in a fuel flow direction from said fuel discharge port.

12. The injector according to claim 7, wherein:

said valve for opening and blocking the fuel discharge passage is disposed downstream in a fuel flow direction from said fuel discharge port.

13. The injector according to claim 9, wherein:

said valve for opening and blocking the fuel discharge passage is disposed downstream in a fuel flow direction from said fuel discharge port.

* * * * *